United States Patent [19]

Baal-Taxa

[11] 4,037,376

[45] July 26, 1977

[54] BUILDING STRUCTURE

[76] Inventor: Baruch Baal-Taxa, 3 Mivzah Kadesh St., Tel Baruch, Israel

[21] Appl. No.: 589,534

[22] Filed: June 23, 1975

[51] Int. Cl.[2] ..... E04H 7/00; E04C 2/38

[52] U.S. Cl. ..... 52/280; 52/498; 312/257 SK

[58] Field of Search ..... 403/169–172, 403/182; 52/280–284, 584, 288, 656, 475, 485, 753 D, 758 CD; 312/257 R, 257 SK, 257 A

[56] References Cited

U.S. PATENT DOCUMENTS

| | | | |
|---|---|---|---|
| 2,167,525 | 7/1939 | Rosendale | 312/257 SK |
| 2,364,083 | 12/1944 | Lindsay | 52/280 |
| 2,394,702 | 2/1946 | Lindsay | 52/753 D |
| 2,691,432 | 10/1954 | Klein et al. | 52/584 |
| 2,904,360 | 9/1959 | Gamlen | 403/171 |
| 3,353,854 | 11/1967 | Hansen | 403/171 |
| 3,477,182 | 11/1969 | Fulton | 52/282 |
| 3,516,215 | 6/1970 | Smith et al. | 52/476 |

*Primary Examiner*—Price C. Faw, Jr.
*Assistant Examiner*—James L. Ridgill, Jr.
*Attorney, Agent, or Firm*—Michael J. Striker

[57] ABSTRACT

A structural assembly comprises at least one structural unit and a set of panels which form the respective walls for the unit.

The structural unit includes profiled channel shaped lower, upper and upright bar elements. The side walls bounding the channel of respective upper elements converge towards one another, and a clamping member is freely vertically movable in this channel. The clamping member has a converging cross section fashioned after that of the channel itself, has an accessible extension portion extending outwardly of this channel.

14 Claims, 7 Drawing Figures

FIG. 1

BUILDING STRUCTURE

OBJECTS OF THE INVENTION

It is the object of the invention to erect the structural elements of the spatial skeleton which can be delivered to the site where the building is to be erected and where the latter can be put, without skilled labour and without the use of tools and connecting means, such as nails, screws, or rivets.

It is the further object of the invention to provide structural elements wherein an assembly of a spatial skeleton and its corresponding panels can be combined with like assembled units to form a larger building.

SUMMARY OF THE INVENTION

The invention resides in the use of profiled elements bar for erecting the said spatial skeleton, the said profile being of a special design, and furthermore in the method enabling the erection of a structure.

According to the invention, the spatial skeleton consists of profiled bar elements, those at least at one of the edges of the structure being channel elements whose two side walls extending from the bottom of the channel coverge towards one another, there being inserted into the channel, and freely moveable therein, a holding member being of a profile similar to that of the channel itself, said holding member having a portion extending out of the channel.

These and further features of the invention will become clearer from the following description taken with reference to the annexed drawings.

BRIEF DESCRIPTION OF DRAWINGS

The invention will now be described with reference to the annexed drawings showing schematically and by way of example a building according to the invention and its constituent parts.

In the drawing.

DESCRIPTION OF THE PREFERRED EMBODIMENT

Figure 1:
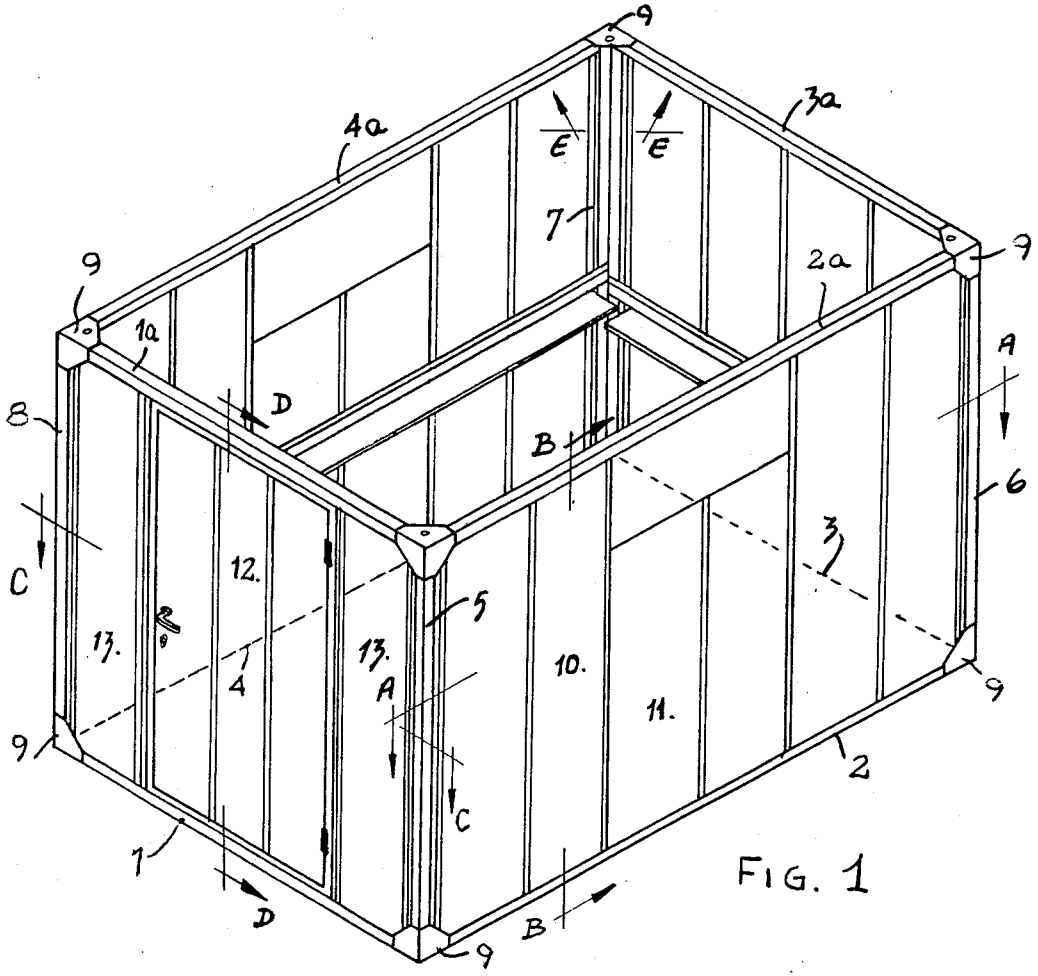
FIG. 1 is a schematical, perspective view of a building according to the invention.

Turning first to FIG. 1, the new building comprises a spatial skeleton which is composed of horizontal bars 1, 2, 3, and 4 (bars 3 and 4 being indicated by broken lines only). These four bars are supposed to be laid out on the ground.

Parallel thereto, at the upper edge of the building, there are provided four, equally horizontal bars 1*a*, 2*a*, 3*a* and 4 *a*. Thus, 1, 2, 3 and 4 form a rectangle or square and so do 1*a*, 2*a*, 3*a* and 4*a*. Between the two rectangles or squares extend the vertical bars indicated by the numerals 5, 6, 7 and 8. At the corners, all bars are connected by the corner pieces 9, in a manner to be described.

Figures 2, 3, 3A, 4, 6:
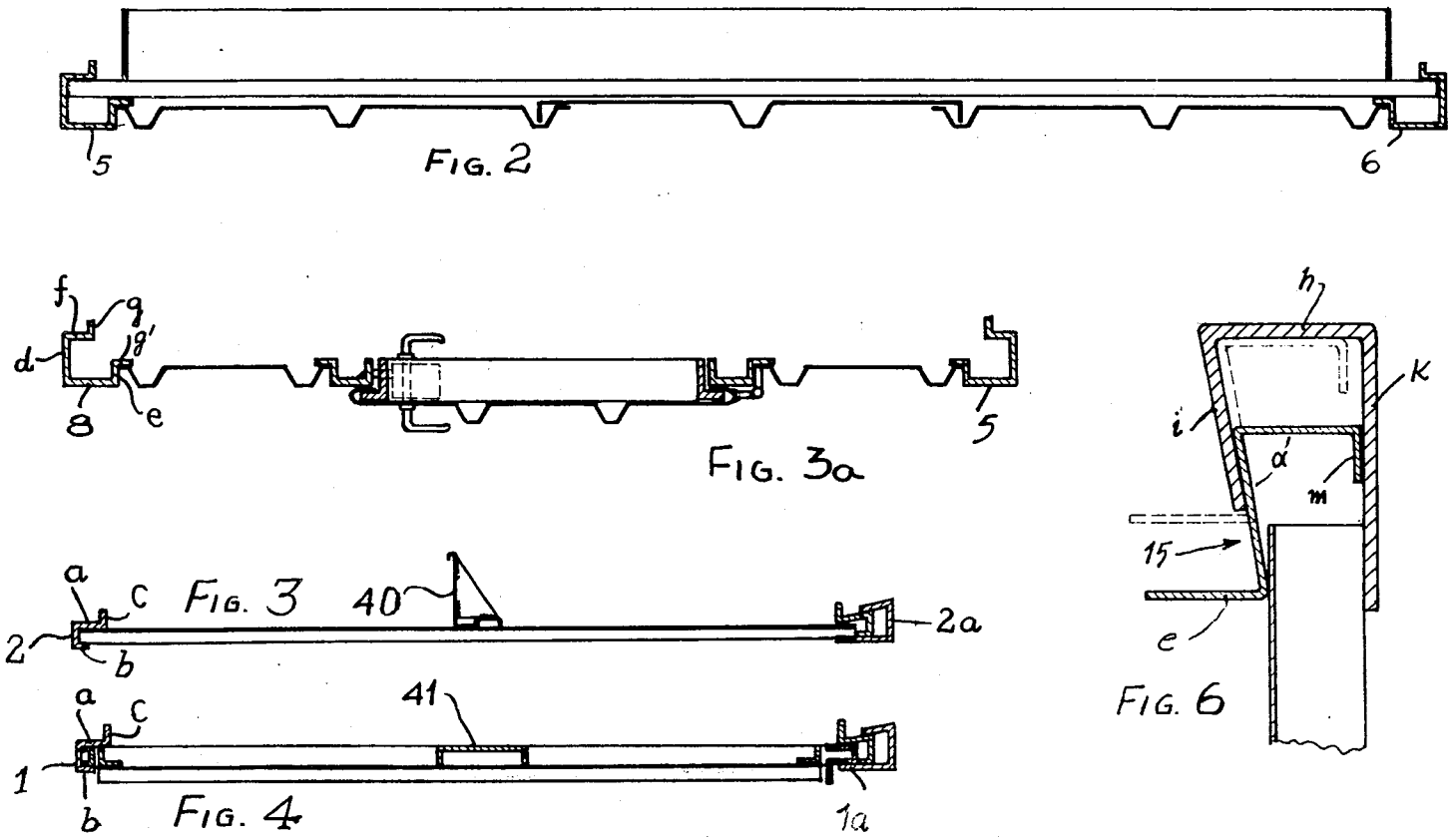
FIG. 2 is a section on line A—A of FIG. 1.
FIG. 3 is a view on line B—B of FIG. 1.
FIG. 3*a* is a view on line C—C of FIG. 1.
FIG. 4 is a section of line D—D of FIG. 1.
FIG. 6 shows a structural detail in section.

All bars 1, 2, 3, 4, and 5, 6, 7, 8 are channel elements. Into the space defined by each of the channels, the panels serving as walls are introduced. In the example shown, the panels are either plain, such as the panel 10 in FIG. 1, or comprise a window such as panel 11, or a door indicated by 12 and flanked by two panels 13. Whether or not the door or windows should be provided on one of the walls, is a matter of choice and designing. Turning now to FIGS. 3 and 4, it can be seen that the bottom bars 1 and 2 (and of course 3 and 4 as well) are channel elements, one side of the channel, i.e. that side or wall of it that comes to lie inside the building and against which the panel leans, is higher than the opposite side of the channel. This higher wall is indicated by the letter *a*, while the opposite wall of the channel is indicated by *b*. The wall *a* has an outwardly bent flange *c*, stiffening the channel element. Where so desired, the floor elements may be laid out and be supported on the flanges *c*.

The upright bars of the skeleton are shown in section in FIGS. 2 and 3*a*. Here, the two walls of the channel are indicated by the letters *d* and *e*, *d* being wider than *e*. However, the wall *d* is extended by a bent off portion *f* which, in turn, is provided with a narrow flange *g* extending at right angles to the portion *f*. The channel wall *e* has a flange $g^1$ whose length is equal to that of the narrow flange *g*, extending normally of the portion *f*.

The top bars 1*a*, 2*a*, 3*a*, and 4*a*, are peculiar profile and serve for holding the panels firmly within the assembled spatial skeleton.

Turning now to FIG. 6, it can be seen that the channel element used for bars 1*a*, 2*a*, and 3*a*, and 4*a*, is an assembly comprising the channel itself, which as can be seen in FIG. 6 comprises the channel bottom wall *h* two oppositely disposed side walls *i* and *k*. As can be seen, the wall *k* which is wider than the wall *i* extends at right angles to the bottom wall *h* while *i* defines, -together with the bottom wall *h*, an acute angle. Consequently, the channel is wider at its bottom than at its open side. Into the channel shown in FIG. 6 fit clamping or holding members which are profiled short lengths of metal sheet forming an angle L, which is equal to the aforementioned acute angle formed by the side and bottom walls bounding the channels upper bars 1*a* to 4*a*. As can be seen in FIG. 6, the clamping member is extended at one side by an outwardly jutting portion *l* and, at its other side, by an oppositely disposed normally bent-off portion *m*. This clamping or holding member is indicated generally by the numeral 15.

Figure 5:
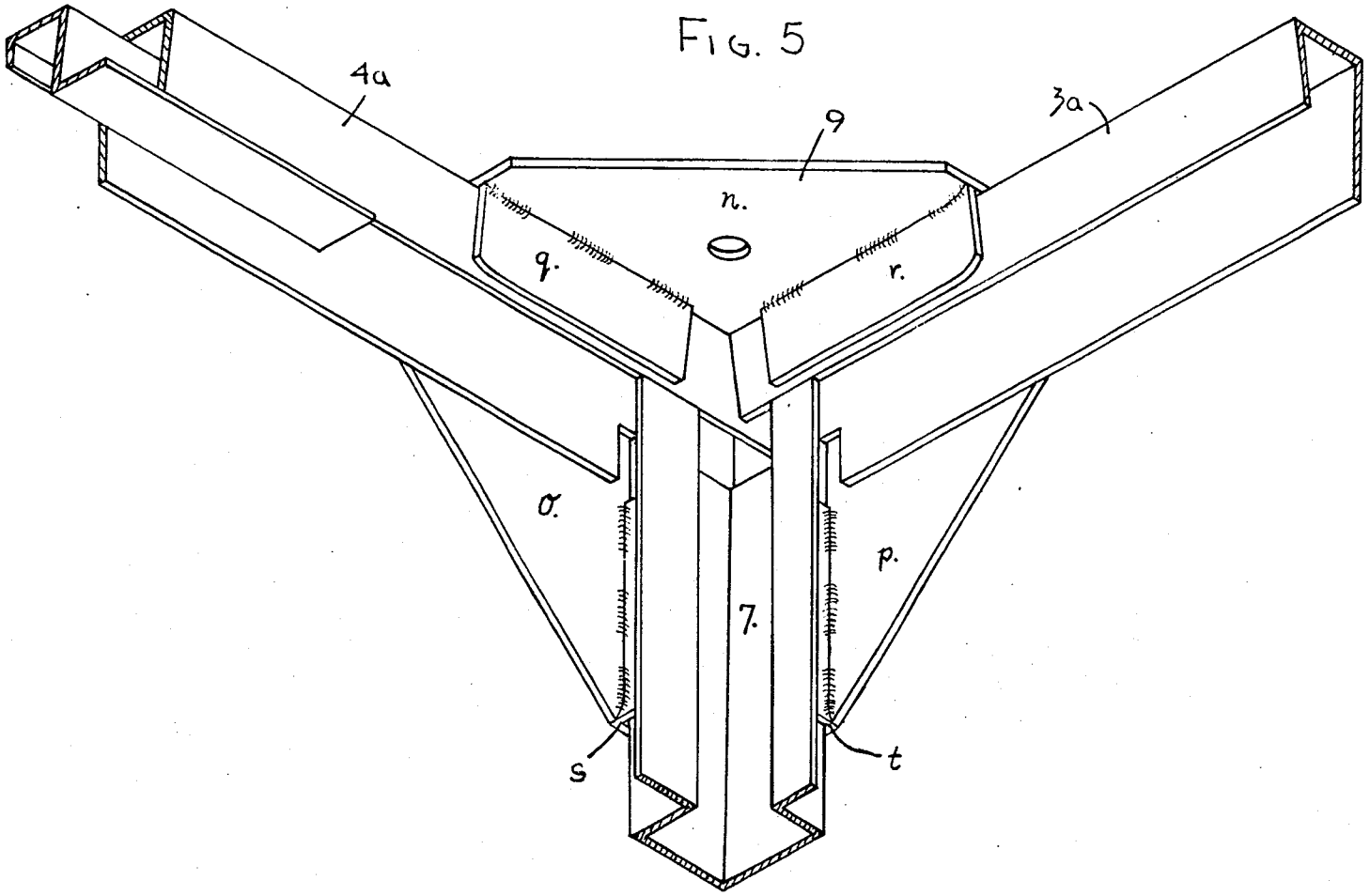
FIG. 5 is a section on line E—E of FIG. 1.

A corner piece and its use is illustrated by FIG. 5. Each of the corner pieces comprise a triangular top plate *n* and two vertical triangular side plates *o* and *p* welded to the plate *n*. To the plate *n* are furthermore welded two short plates *q* and *r* which extend in planes parallel to the triangular plates *o* and *p* at a distance therefrom. Two further plates *s* and *t* extend at a right angle from plates *o* and *p*.

In assembling first the skeleton which is intended to hold the wall panels, the four profiled bars 1, 2, 3 and 4 are connected by the connecting members 9 shown in FIGS. 1 and FIG. 5. This is simply done by inserting the profiled bars 1–4 into the space defined between the triangular plates *o* and *q* and *p* and *r* respectively. Obviously the distance between the triangular. plates and small plates *q* and *r* is such that the bars 1–4 fit thereinto and in fact have to be forced into the space. The bars 1–4 are held in the aforementioned spaces by friction and due to the springiness of the metallic parts of the connector 9.

The so-obtained rectangular or square frame is placed on the ground. Now, the vertical bars, which according to the example of FIG. 1 are numbered 5, 6, 7 and 8, can be connected thereto. The right angle of the bars (see also FIG. 3) fits into the right angle defined by the member 9 while the lateral walls of the member with the flanges bent off therefrom, interengage with the already laid out horizontal bars 1–4. Finally, another frame to be disposed horizontally is assembled in the same way as the one now laying in the ground, and is placed on top of the structure 1 the four vertical bars of the spatial skeleton entering into the four connectors which connect the last mentioned four bars, and which according to the example, are numbered 1*a*, 2*a*, 3*a*, and 4*a*. As has been explained already, the four bars 1*a* –4*a* have a special profile explained in connection with FIG. 6.

Once the spatial skeleton has been erected, the insertion of the panels can be started. These panels are made up of sheet metal or any other appropriate material, such as plastics or glass fiber reinforced synthetic resin sheets, and have vertically extending embossed stiffening ribs, as can be seen in all the figures. The panels may be plain, i.e. have no window openings or door openings or they may have such. In order to insert the panels, the clamping member 15 described in connection with FIG. 6 is inserted into the upper horizontal bars and pushed upwardly until it abuts against the bottom wall *h*, (shown in FIG. 6 by broken lines.). This makes it possible to slide a panel into any one of the four upper bars (1*a*–4*a*) and then let it drop for a short distance to enter into the cavity of a respective lowermost horizontal bar 1–4. Now, clamping the member 15 by means of its outwardly extending arm *l* may be pulled down as shown in FIG. 6. Thereby the part *m* slides on the wall *k* of the profile while the opposite the clamping of member 15 slides on the wall *i* of the channel. In this way, a wedging effect is obtained, and the panel is firmly held in wedged in place being firmly pressed against the part *k* of the profile.

In this way, all the panels are inserted until the four walls are fully closed.

Obviously the panels may be provided at their inside with an insulating layer of soft board or plastics. In the case of store rooms etc,. no insulating layer might to required. As can be seen in FIGS. 2 and 3 it is possible to provide the panels with an internally extending shelf indicated by the reference numeral 40. The door which is shown in FIGS. 3 and 4 may be reinforced by a board-like profile 41.

The structure just described is a four sided cabin like building onto which a roof of whatever kind can be put. However, it is possible to combine two or more of these structures simply by omitting one wall and placing them against one another with the open side thereof and connect the respective vertical bars of the skeleton in any appropriate way. In that manner, two, three, or even more of the described units may be connected to form larger assemblies.

What is claimed is:

1. A structural assembly including at least one structural unit, comprising a plurality of panels each having edge portions; means forming a base frame for said unit, including a plurality of lower elements each having channels for receiving lower edge portions of a respective panel; means forming a top frame for said unit, including a plurality of upper elements each having channels for receiving upper edge portions of a respective panel, each channel of an upper element having a closed side, an open side opposite said closed side, and a pair of side walls extending intermediate said closed and open sides, one of said side walls converging towards the other of said side walls in direction towards said open side; means connecting said base frame to said lower frame, including a plurality of upright elements intermediate said lower and upper elements, each upright element having a channel receiving side edge portions of a respective panel; and wedging means securing a respective panel in said channels, including wedging members each having a movable portion in a respective channel of an upper element, each movable portion having a first part in sliding engagement with extending generally parallel to an inner surface of said one side wall, and a second part overlying an inner surface of said other side wall, each wedging member also having a handle portion located exteriorly of said respective channel and operative for moving an movable portion so that said first part slides along said one side wall between an inoperative retracted position and an operative panel-wedging position in which said second part frictionally engages a region of said other side wall and in which said first part frictionally engages said upper edge portions of said respective panel so as to wedge the latter against another region of said other side wall.

2. A structural assembly including at least one structural unit, comprising a plurality of panels each having edge portions; a plurality of lower and upper channel-shaped elements respectively forming a base frame and a top frame for said unit, each of said channels of said upper elements having an open side and wall portions bounding an interior space; a plurality of upright channel-shaped elements connecting said top frame to said base frame, all of said elements having channels receiving the edge portions of a respective panel; and means wedging edge portions of a respective panel into frictional engagement with said wall portions, said wedging means including wedging members each having a wedge portion mounted for movement in said space between a retracted position and a panel-wedging position, and handle means located exteriorly of said space and operative for moving said wedge portion in direction towards the open side of a respective channel of said upper elements into frictional wedging engagement with said wedge portions so as to tightly secure a respective panel in position, and for moving said wedge portion in opposite direction so as to disengage said respective panel from the assembly.

3. A structural assembly as defined in claim 2, wherein said base and top frames have a four-sided configuration, and wherein four of said plurality of upright elements connect said top frame to said base frame so that said unit has a rectangular parallelepiped configuration.

4. A structural assembly as defined in claim 2, wherein each of said channels respectively associated with said upright elements is bounded by a long wall and a relatively shorter wall, said long wall having an L-shaped portion and said relatively shorter wall having a perpendicularly-extending portion.

5. A structural assembly as defined in claim 2, wherein each of said channels respectively associated with said lower elements is bounded by a long wall and a relatively shorter wall, said long wall having a stiffening portion extending normally of the latter.

6. A structural assembly as defined in claim 2, wherein each of said panels has rib means embossed thereon for stiffening said panels.

7. A structural assembly as defined in claim 2, wherein each of said panels is comprised of metal material and an insulating layer.

8. A structural assembly as defined in claim 2; said unit further comprising triangular corner elements for interconnecting said upright elements to said upper and lower elements, respectively.

9. A structural assembly as defined in claim 2, wherein a plurality of said units are interconnected to form said structural assembly.

10. A structural assembly as defined in claim 2, wherein each of said channels respectively associated with upper elements is bounded by a bottom wall and a pair of side walls at opposite lateral sides of said bottom wall, one of said side walls converging towards the other of said side walls and forming an acute angle with said bottom wall.

11. A structural assembly as defined in claim 10; said unit further comprising each of said wedging insertable and freely vertically movable in a respective channel of said upper elements.

12. A structural assembly as defined in claim 11, wherein each of said wedge portions has a first wall overlying said bottom wall of said respective channel, a second wall overlying said other side wall and extending normally of said first wall, and a third wall overlying said one converging side wall and forming an acute angle with said first wall.

13. A structural assembly as defined in claim 12, said handle means extending normally of the elongation of said channel.

14. A method of assembling a structural assembly from structural units comprised of channel-shaped elements and panels, comprising the steps of forming a base frame for a structural unit of lower elements having channels for receiving lower edge portions of a respective panel; forming a top frame for a structural unit of upper elements having channels for receiving upper edge portions of a respective panel, each channel of an upper element having a closed side, an open side opposite side closed side, and a pair of side walls extending intermediate side closed and open sides, one of said side walls converging towards the other of said side walls in direction towards said open side; connecting said base frame to said top frame with a plurality of upright elements having channels for receiving side edge portions of a respective panel; inserting a movable portion of a wedging member into a respective channel of an upper element so that a first part of said movable portion is in sliding relationship with said one side wall, and a second part of said movable portion overlies said other side wall; inserting a respective panel into said channels so that the edge portions of the respective panel are respectively received in said channels of all of said elements; and wedging said respective panel in position in said channels by pulling a handle portion of the wedging member in direction from said top frame towards said base frame, said wedging step including the step of sliding said first part along said one side wall until said second part frictionally engages a region of said other side wall and until said first part frictionally engages the upper edge portions of said respective panel so as to wedge the latter against another region of said other side wall.

* * * * *